US005870651A

United States Patent [19]

Shimada

[11] Patent Number: 5,870,651

[45] Date of Patent: Feb. 9, 1999

[54] DEVELOPING DEVICE WITH A SEALING MEMBER TO PREVENT DEVELOPER LEAKAGE

[75] Inventor: Hirokatsu Shimada, Toyokawa, Japan

[73] Assignee: Minolta Co., Ltd., Osaka, Japan

[21] Appl. No.: 957,319

[22] Filed: Nov. 6, 1997

[30] Foreign Application Priority Data

Nov. 12, 1996 [JP] Japan ..... 8-299999
Sep. 26, 1997 [JP] Japan ..... 9-261169

[51] Int. Cl.[6] ..... G06G 15/08

[52] U.S. Cl. ..... 399/102; 399/103

[58] Field of Search ..... 399/98, 102, 103, 399/222, 252, 258, 262, 265, 279, 286

[56] References Cited

U.S. PATENT DOCUMENTS 4,827,305 5/1989 Enoguchi et al. ..... 399/119
5,057,868 10/1991 Sekino et al. ..... 399/105
5,221,943 6/1993 Hasegawa ..... 399/11
5,293,199 3/1994 Saito et al. ..... 399/103
5,389,732 2/1995 Sekino ..... 399/103
5,541,710 7/1996 Stewart et al. ..... 399/98
5,606,397 2/1997 Honda et al. ..... 399/98
5,649,270 7/1997 Omata et al. ..... 399/262

*Primary Examiner*—Arthur T. Grimley
*Assistant Examiner*—Hoan Tran
*Attorney, Agent, or Firm*—Burns, Doane, Swecker & Mathis, LLP

[57] ABSTRACT

A developing device includes a developer carrying member opposed to an electrostatic latent image carrier and carrying developer on its surface, a sealing member in contact with a surface of each end of the developer carrying member, and a developer entry preventing filler interposed between the developer carrying member and the sealing member for preventing entry of the developer, and containing fine powder. The fine powder has a volume average particle diameter of 1 μm or less, and is made of an organic or inorganic material. The filler may contain silicon oil or grease.

25 Claims, 2 Drawing Sheets

DEVELOPING DEVICE WITH A SEALING MEMBER TO PREVENT DEVELOPER LEAKAGE

BACKGROUND OF THE INVENTION

1. Field of the Invention

The present invention relates to a developing device for developing an electrostatic latent image in an image forming apparatus such as an electrophotographic copying machine or printer.

2. Description of the Background Art

The electrophotographic image forming apparatus generally produces an intended image in such a manner that an electrostatic latent image is formed, e.g., by effecting an image exposure corresponding to an original image on an electrostatic latent image carrier such as a photosensitive member, and then is developed by a developing device into a visible image, which is transferred and fixed onto a record member.

Various developing devices of the above type have been proposed and employed. These devices usually include developing rollers. The developing roller carries a thin film of developer supplied thereto, and rotates to transfer the developer carried thereon to a developing region, at which the developing roller and the electrostatic latent image carrier are opposed to each other, for developing the electrostatic latent image.

The developing device is also provided with means for preventing leak of the developer.

This developer leak preventing means is arranged at a portion(s) where the developer may leak. In connection with the developing roller, these means are employed for preventing leak of the developer from the opposite ends of the roller. Particularly, in the developing device having the developing roller which is in contact with the electrostatic latent image for developing the same, the leak preventing means are provided for preventing movement of surplus developer from the ends of the developing roller onto the electrostatic latent image carrier. As the above means, such as structure has been known that an arc-shaped sealing member arranged within the developing device is in contact with a surface of each end of the developing roller facing to the interior of the developing device.

This sealing member is in contact with the roller end in such a manner that the member does not impede rotation of the developing roller but can prevent the developer from entering an area between the surface of the roller end and the sealing member and leaking therefrom. It has been recognized that the member can achieve a developer leak preventing effect to some extent. However, it is now desired to prevent leak of the developer more reliably.

The reason is as follows. In the present devices, developer may enter the space between the sealing member and the developing roller. The developer in the space gradually solidifies in accordance with rotation of the developing roller, and thereby increases the gap between the sealing member and the developing roller, so that the developer externally leaks to cause problems such as smearing of an interior of the image forming apparatus. Also, the quantity of the developer in the space is impaired due to rubbing against the rotating developing roller so that the developer of the impaired quality causes a so-called fogging phenomenon at the end of the electrostatic latent image carrier, resulting in a problem that the quality of the image transferred onto the record member is impaired.

SUMMARY OF THE INVENTION

Accordingly, it is an object of the invention to provide a developing device, which can suppress disadvantages more reliably than the prior art and more specifically can suppress such disadvantages that developer may leak from an end of a developing roller and that deterioration of the developer occurs at the end of the developing roller and causes the fogging at the end of the electrostatic latent image carrier.

The developing device of the invention includes:

- a developer carrying member opposed to an electrostatic latent image carrier and carrying developer on its surface;
- a sealing member in contact with a surface of each end of the developer carrying member; and
- a developer entry preventing filler interposed between the developer carrying member and the sealing member for preventing entry of the developer, said developer entry preventing filler contains fine powder.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
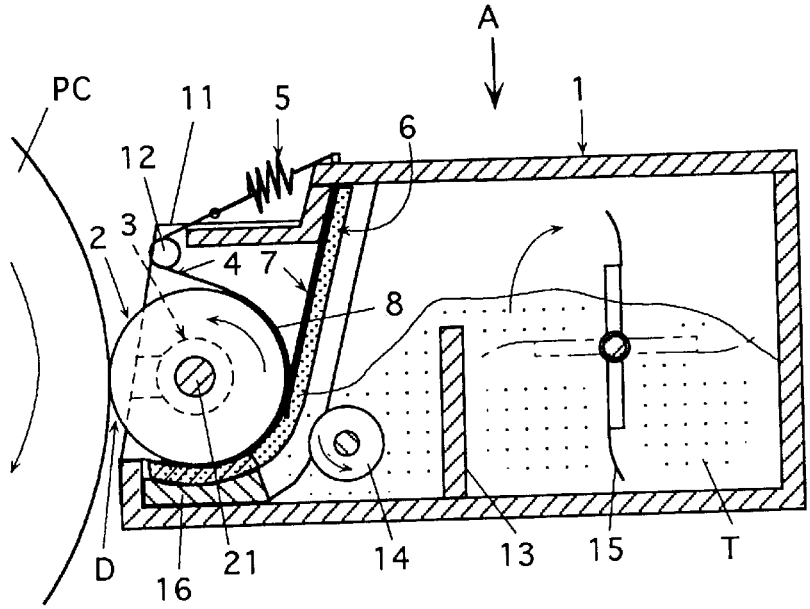
FIG. 1 is a schematic cross section of a developing device of an embodiment of the invention.

A developing device of the invention includes a developer carrying member opposed to an electrostatic latent image carrier and carrying developer on its surface; a sealing member in contact with a surface of each end of the developer carrying member; and a developer entry preventing filler interposed between the developer carrying member and the sealing member for preventing entry of the developer, and containing fine powder.

The developer entry preventing filler may be made of fine powder which does not impede formation of an image.

The fine powder may have a particle diameter which allows particles of the powder to enter fine concavities at the surface(s) of the developing roller and/or sealing member. In view of general surface roughness of the developing roller and the sealing member, the fine powder may have a volume average particle diameter of about 1 $\mu$m or less, preferably about 0.1 $\mu$m or less and more preferably about 0.05 $\mu$m or less. The fine powder may be made of an organic material such as polyvinylidene fluoride, PMMA (polymethyl methacrylate), polytetrafluorethylene, benzoguanamine, silicon, polyamide or stearic acid. It may also be made of an inorganic material (inorganic solid lubricant) such as carbon fluoride, graphite fluoride, calcium fluoride, molybdenum disulfide, tungsten disulfide, boron nitride, graphite or synthetic mica. The allowable minimum diameter of the particle is about 0.01 $\mu$m.

The above fine powder may be used together with oil or grease. The oil may be typically silicon oil. The silicon oil may have a viscosity from about 100 cST to about 30000 cST.

The grease may contain, for example, PTFE (polytetrafluorethylene) dispersed therein such as "Fusso Grease" (TOMBO 9401 manufactured by Nichiasu Kabushiki Kaisha).

The filler may be held, in advance, in the sealing member, e.g., by impregnation or application, or may be held, in advance, at the surface of the developer roller end, e.g., by applying the filler onto the surfaces of the ends of the developing roller before an operation. Further, both of these manners may be used to interpose the filler between the sealing member and the developing roller.

In any case, the filler may be held on the developing roller surface for moving the filler to a space between the roller and the sealing member and thereby interposing the filler therebetween. For this purpose, the filler may be supplied directly to the end of the developing roller. Alternatively, the filler may be supplied to the electrostatic latent image carrier having a moving surface which is in contact with the developing roller so that the filler may move onto the developing roller.

According to the developing device of the invention, since the developer entry preventing filler is interposed between the developing roller and the sealing member, entry of the developer into the space between the roller and sealing member can be suppressed more reliably than the prior art, which prevents external leak of the developer, and also suppresses deterioration of the developer at the sealing member and thereby the fogging phenomenon at the end of the electrostatic latent image carrier.

If the filler is used together with a liquid or a viscous substance, the developer adheres onto an edge portion of the sealing member near the center of the developing roller, and thereby forms a kind of wall, which also suppresses entry of the developer into the space between the developing roller and the sealing member.

An embodiment of the invention will now be described below with reference to the drawings.

FIG. 1 is a schematic cross section showing a developing device according to the invention and also shows a portion of a photosensitive drum PC which is an example of an electrostatic latent image carrier.

Figure 2:
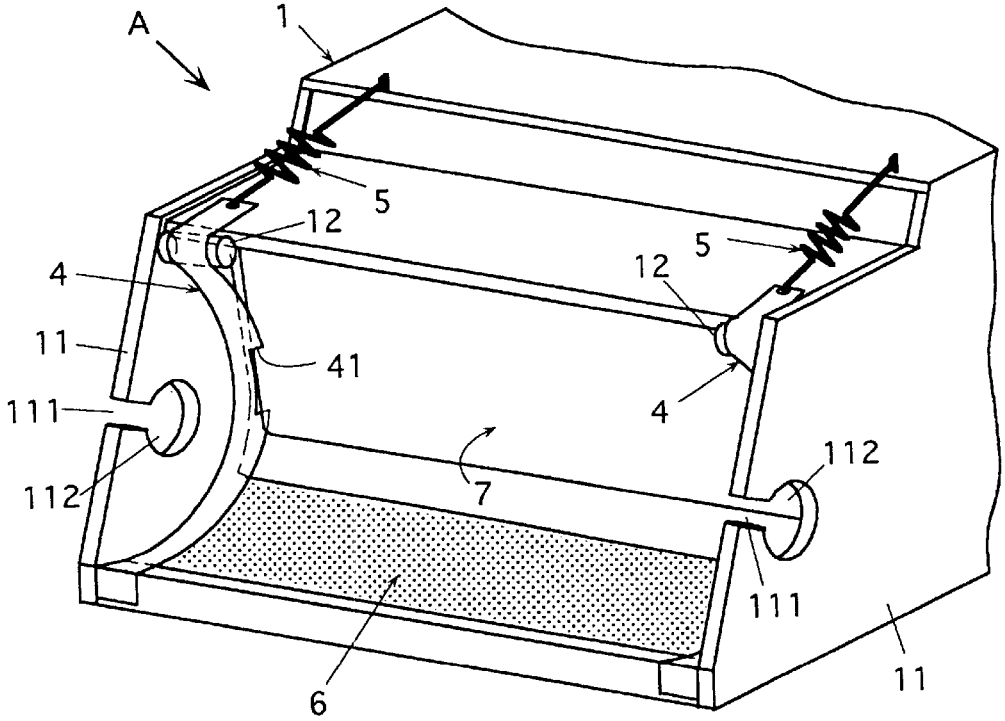
FIG. 2 is a perspective view of the developing device shown in FIG. 1 with a developing roller removed.
Figure 3:
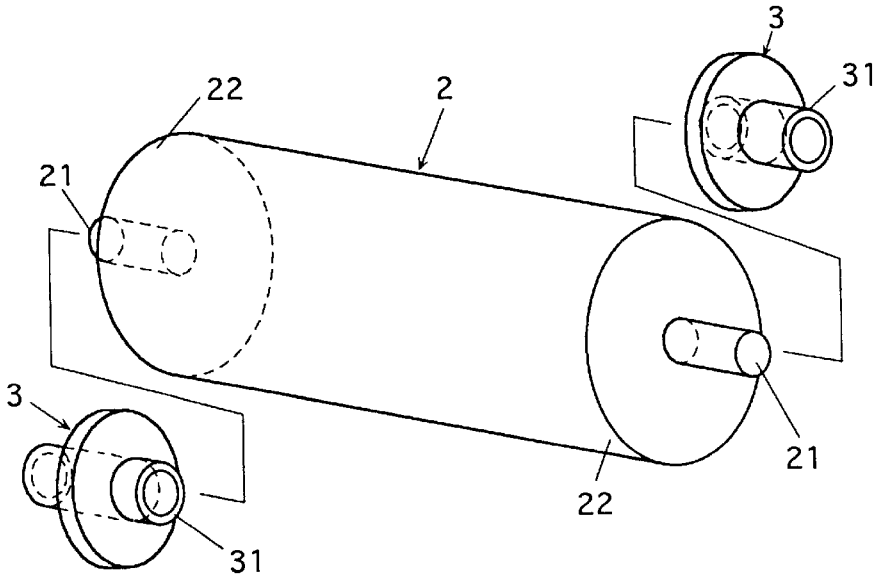
FIG. 3 is a perspective view of the developing roller and its bearing members.
Figure 4:
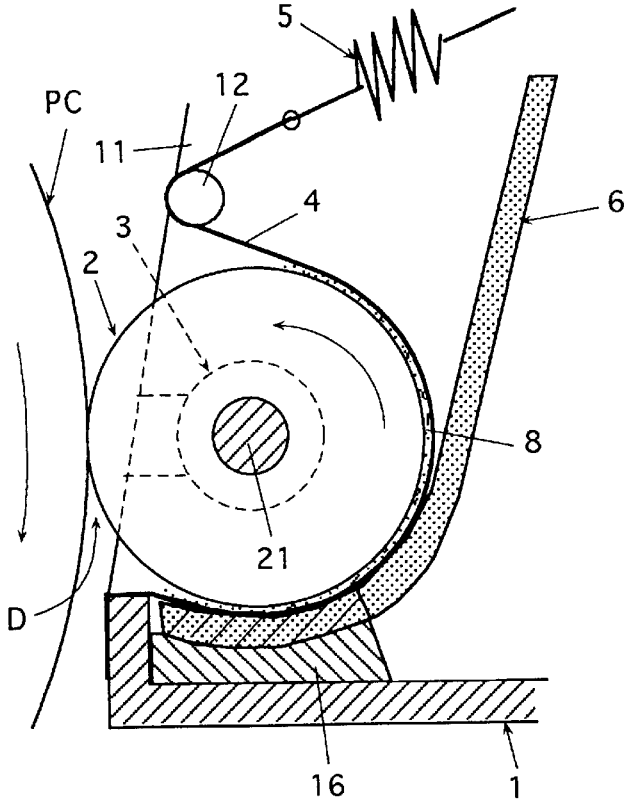
FIG. 4 is a sectional view showing, on an enlarged scale, the developing roller, a sealing member and a structure around them in the developing device shown in FIG. 1.

This developing device A uses toner T which is one-component developer, and includes a box 1 accommodating toner T as well as a developing roller 2. The developing roller 2 is arranged at an opening formed at one side of the box 1, and is rotatably carried at its opposite ends by the box 1. More specifically, developing roller 2 has shafts 21 protruding from its opposite ends of the roller 2, respectively, as shown in FIGS. 1 and 3. These shafts 21 are fitted through grooves 111 (see FIG. 2) extending rearward from front ends of opposite side walls 11 of the box 1 and are arranged in circular apertures 112 continuous to the grooves 111, respectively. After the fitting, a bearing member 3 is attached to each side wall 11 from the external side. The bearing member 3 has a circular cylindrical portion 31, which is fitted around the developing roller shaft 21 and into the circular aperture 112 at the box side wall 11, and is coupled to the side wall 11 by unillustrated fixing means. In this manner, the developing roller 2 is rotatably carried by the box 1. An unillustrated drive means drives the developing roller 2 to rotate counterclockwise in FIG. 1. The developing roller 2 has a portion which is exposed externally through the opening at the box, and is in contact with a photosensitive drum PC through a contact portion forming a developing region D. The photosensitive drum PC is driven by an unillustrated drive means to rotate clockwise in the figure.

Belt-like sealing members 4 are arranged in the box. The sealing members have arc-shaped portions which are in contact with the surfaces of the opposite ends 22 of the developing roller 2, respectively.

Each sealing member 4 has a lower portion, which extends downward through an area under the lower front portion of the developing roller 2 and is coupled to the lower portion of the box. Each sealing member 4 also has an upper portion, which extends upward through an area above the upper front portion of the developing roller 2 and is retained around a support member 12 provided at the box 1. This upper portion further extends rearward from the member 12, and is coupled to the upper portion of the box 1 through a tension spring 5. Thereby, the sealing member 2 is elastically brought into contact with the developing roller 2 by the spring 5 while allowing rotation of the developing roller 2. The outer edge of each sealing member 4 is located near the inner surface of the side wall 11 of the box 1.

An elastic member 6 extends from a position at the rear of one of the sealing members 4 along the lower surface of the developing roller 2, and further extends continuously to the rear of the other sealing member 4. This member 6 presses each sealing member 4 forwardly against the developing roller 2, and is in contact with the lower surface of the developing roller 2 between the sealing members 4 to prevent leak of the toner. A space between the lower surface of the elastic member 6 and the bottom of the box 1 is closed by a member 16 arranged at the box 1. The outer edges of the portions of the elastic member 6 extending along the rear sides of the sealing member 4 are in contact with the inner surfaces of the box side walls 11, respectively.

A plate-like toner restricting member 7 is arranged between a portion which is defined between the edge of one of the sealing members 4 near the interior of the developing device and a portion of the elastic member 6 behind the member 4, and a portion which is defined between the edge of the other sealing members 4 near the interior of the developing device and a portion of the elastic member 6 behind this member 4. The toner restricting member 7 is in contact with the rear surface of the developing roller 2 facing the interior of the developing device. Each sealing member 4 is provided with a recess 41 in which the toner restricting member 7 is partially located. The elastic member 6 is formed of portions extending at the rear of the opposite sealing members 4 and a portion extending along the lower surface of the developing roller 2, and also has a recess at its upper central area surrounded by these portions.

In the box 1, a partition 13 extends upward from the bottom, and a toner supply rotary member 14 near the developing roller 2 and a toner stirring rotary member 15 remote from the developing roller 2 are arranged with the partition 13 therebetween. The members 14 and 15 are driven by an unillustrated drive means to rotate counterclockwise and clockwise in the figure, respectively.

A toner entry preventing filler 8 is interposed between each sealing member 4 and the neighboring end 22 of the developing roller 2.

The filler 8 is fine powder of polyvinylidene fluoride having a volume average particle diameter of about 0.05 $\mu$m. The sealing member 4 in this embodiment is made of expanded urethane foam, and holds the fine powder of polyvinylidene fluoride in its voids.

According to the developing device A described above, the developing roller 2 and rotary members 14 and 15 are driven to rotate. The toner T which is supplied to the developing roller 2 and is shaped into a charged toner thin layer by the toner restricting member 7 is held on the surface of the developing roller, and is transported to the developing region D for developing the electrostatic latent image formed on the photosensitive drum PC.

During an operation of the developing device A, entry of the toner T into a space between roller 2 and sealing member 4 is suppressed more reliably than the prior art because the fine powder 8 of polyvinylidene fluoride serving as the developer entry preventing filler is interposed between the opposite ends 22 of the developing roller 2 and the sealing members 4 in contact with them. Thereby, external leak of the toner T is prevented, deterioration of the quality of the toner at the sealing members 4 and thereby a fogging phenomenon at the ends of the photosensitive drum PC are also suppressed.

The filler may contain silicon oil which is used together with fine powder 8 of polyvinylidene fluoride. The filler may be made of grease, e.g., "Fusso Grease" (TOMBO 9401 manufactured by Nichiasu Kabushiki Kaisha) containing PTFE (polytetraf luorethylene) dispersed therein.

If the silicon oil or grease is used together with the fine powder, the silicon oil or grease is interposed between the developing roller 2 and the sealing member 4 so that the toner adheres onto an edge portion of each sealing member 4 near the center of the developing roller and thereby forms a kind of wall. This also suppresses entry of the toner T into the space between the developing roller 2 and the sealing member 4.

The filler described above fills gaps which are formed between the surfaces of the ends of the developing roller 2 and the surface of the sealing member 4 due to the irregularities at these surfaces, so that entry of the toner can be effectively suppressed.

Although the embodiment has been described in connection with the nonmagnetic one-component developing device which uses the developer carrying member (developing roller) not provided with a magnetic member, the invention is not restricted to this, and may be applied to a magnetic one-component developing device using the developer carrying member which is internally provided with a magnetic member as well as a two-component developing device.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing device comprising:

a developer carrying member opposed to an electrostatic latent image carrier and carrying developer on its surface;

a sealing member in contact with a surface of each end of said developer carrying member; and a developer entry preventing filler interposed between said developer carrying member and said sealing member for preventing entry of the developer, said developer entry preventing filler containing fine powder and a liquid substance selected from the group consisting of silicone oil and grease.

2. The developing device according to claim 1, wherein said fine powder has a volume average particle diameter of 1 $\mu$m or less.

3. The developing device according to claim 2, wherein said fine powder has a volume average particle diameter from 0.01 $\mu$m to 1 $\mu$m.

4. The developing device according to claim 3, wherein said fine powder has a volume average particle diameter from 0.01 $\mu$m to 0.1 $\mu$m.

5. The developing device according to claim 1, wherein said fine powder is made of organic fine powder.

6. The developing device according to claim 1, wherein said fine powder is made of inorganic fine powder.

7. The developing device according to claim 1, wherein said developer entry preventing filler contains silicon oil.

8. The developing device according to claim 1, wherein said developer entry preventing filler contains grease.

9. The developing device according to claim 1, wherein said sealing member is in contact with the surface of said developer carrying member through at least an area inside said developing device.

10. The developing device according to claim 1, wherein said sealing member is made of urethane foam.

11. The developing device according to claim 1, wherein said sealing member has voids which hold the fine powder.

12. A nonmagnetic one-component developing device comprising:

a developer carrying member opposed to an electrostatic latent image carrier and carrying one-component developer on its surface;

a developer restricting member forming a layer of the one-component developer of a predetermined film thickness on the surface of said developer carrying member;

a sealing member in contact with a surface of each end of said developer carrying member; and a developer entry preventing filler interposed between said developer carrying member and said sealing member for preventing entry of the developer, said developer entry preventing filler containing fine powder and a liquid substance selected from the group consisting of silicone oil and grease.

13. The developing device according to claim 12, wherein said fine powder has a volume average particle diameter of 1 $\mu$m or less.

14. The developing device according to claim 13, wherein said fine powder has a volume average particle diameter from 0.01 $\mu$m to 1 $\mu$m.

15. The developing device according to claim 14, wherein said fine powder has a volume average particle diameter from 0.01 $\mu$m to 0.1 $\mu$m.

16. The developing device according to claim 12, wherein said fine powder is made of organic fine powder.

17. The developing device according to claim 12, wherein said fine powder is made of inorganic fine powder.

18. The developing device according to claim 12, wherein said developer entry preventing filler contains silicon oil.

19. The developing device according to claim 12, wherein said developer entry preventing filler contains grease.

20. The developing device according to claim 12, wherein said sealing member is in contact with the surface of said developer carrying member through at least an area inside said developing device.

21. The developing device according to claim 12, wherein said sealing member is made of urethane foam.

22. The developing device according to claim 12, wherein said sealing member has voids which hold the fine powder.

23. A developing device including a box comprising:

a developer carrying member opposed to an electrostatic latent image carrier and carrying developer on its surface;

a sealing member forming a seal with a surface of each end of said developer carrying member, said sealing member attached at one end thereof to a tension member, and another end of said sealing member overlapping and coupled to a lower portion of the box, said sealing member extending over at least 180° of said developer carrying member; and a developer entry preventing filler interposed between said developer carrying member and said sealing member for preventing entry of the developer, said developer entry preventing filler containing fine powder.

24. A non-magnetic one-component developing device including a box comprising:

a developer carrying member opposed to an electrostatic latent image carrier and carrying one-component developer on its surface;

a developer restricting member forming a layer of the one component developer of a predetermined film thickness on the surface of said developer carrying member;

a sealing member forming a seal with a surface of each end of said developer carrying member, said sealing member attached at one end thereof to a tension member, and another end of said sealing member overlapping and coupled to a lower portion of the box, said sealing member extending over at least 180° of said developer carrying member; and a developer entry preventing filler interposed between said developer carrying member and said sealing member for preventing entry of said developer, said developer entry preventing filler containing fine powder.

25. A developing device including a box comprising:

a developer carrying member opposed to an electrostatic latent image carrier and carrying developer on its surface;

a sealing arrangement forming a seal with a surface of each end of said developer carrying member, said sealing arrangement including a first and second separate belt sealing member, each sealing member wrapped at least partially over a support member and attached at one end to a tensioning member, an opposite end of each sealing member overlapping and connected to a lower portion of the box; and a developer entry preventing filler interposed between said developer carrying member and said sealing member for preventing entry of the developer, said developer entry preventing filler containing fine powder.

* * * * *